US008979200B2

(12) United States Patent
Chen

(10) Patent No.: US 8,979,200 B2
(45) Date of Patent: Mar. 17, 2015

(54) ASSEMBLY FOR TILTING A SEAT

(76) Inventor: Su-Ming Chen, Kaohsiung (TW)

( * ) Notice: Subject to any disclaimer, the term of this patent is extended or adjusted under 35 U.S.C. 154(b) by 310 days.

(21) Appl. No.: 13/526,551

(22) Filed: Jun. 19, 2012

(65) Prior Publication Data

US 2013/0334855 A1 Dec. 19, 2013

(51) Int. Cl.
*A47C 1/026* (2006.01)
*A47C 7/60* (2006.01)
*A47C 1/024* (2006.01)

(52) U.S. Cl.
CPC ..... *A47C 1/026* (2013.01); *A47C 1/024* (2013.01)
USPC ..... 297/302.4; 297/302.7

(58) Field of Classification Search
CPC ..... A47C 1/024; A47C 1/026
USPC ..... 297/302.3, 302.4, 300.8, 301.7, 302.7
See application file for complete search history.

(56) References Cited

U.S. PATENT DOCUMENTS 3,975,050 A * 8/1976 McKee ..... 297/328
4,372,611 A * 2/1983 Feddeler ..... 297/371
6,033,020 A * 3/2000 Ito ..... 297/302.4
6,174,031 B1 * 1/2001 Lindgren et al. ..... 297/463.1
6,419,320 B1 * 7/2002 Wang ..... 297/344.19
6,488,336 B1 * 12/2002 Wang ..... 297/301.7
6,921,134 B1 * 7/2005 Hong ..... 297/301.7
6,957,862 B2 * 10/2005 Chen ..... 297/300.1
6,957,864 B2 * 10/2005 Chen ..... 297/302.5
7,293,832 B2 * 11/2007 Huang ..... 297/300.8
7,766,426 B2 * 8/2010 Meidan ..... 297/303.4
7,866,749 B2 * 1/2011 Costaglia et al. ..... 297/300.5
8,613,482 B2 * 12/2013 Ni ..... 297/302.3

* cited by examiner

*Primary Examiner* — David R Dunn
*Assistant Examiner* — Tania Abraham
(74) *Attorney, Agent, or Firm* — Leong C. Lei

(57) ABSTRACT

The assembly contains a base and a tilt adjustment member. The base has a frame with a seat attachment piece for attaching the frame to a seat cushion of a seat. A locking element is configured in the frame and has a number of notches. In front of the locking element, the frame has a fastening section so that the tilt adjustment member can be accommodated. Each of the lateral sides of the frame has a through hole for a control rod to thread through. The tilt adjustment member contains a swing block, a seat, a locking piece, and a twisting element. By configuring the locking element and the tilt adjustment member on the base, and by using the control rod to engage the locking piece of the tilt adjustment member to interact the notches of the locking element, the seat can be tilted with simple operation and limited effort.

5 Claims, 9 Drawing Sheets

ASSEMBLY FOR TILTING A SEAT

TECHNICAL FIELD OF THE INVENTION

The present invention is generally related to an assembly for tilting a seat, and more particularly to an assembly for tilting a seat that provides convenient and simplified adjustment so as to enhance the seat's utility.

DESCRIPTION OF THE PRIOR ART

As shown in FIGS. 1 to 3, R.O.C. Taiwan Patent No. I245616 teaches an assembly for tilting a seat.

The assembly 1 contains a locking element 11 having a top section 111, a bottom section 113, and two lateral sections 112. The locking element 11 also has a locking block 114 attached to a back end of the bottom section 113. At least two vertically arranged notches 1141 are provided on a back side of the locking block 114.

The assembly 1 also contains a frame 12 having a top piece 121 and two downward-extended lateral pieces 122. The locking element 11 is pivotally positioned between the lateral pieces 122 by a first axle. The top piece 121 has a back section 124 and a front section 123 against which the top section 111 is elastically pressed.

The assembly 1 also contains a tilt adjustment member 2 joined to the locking element 11 behind the locking block 114. The tilt adjustment member 2 contains a seat 21 fixedly attached to the top piece 121 of the frame 12, a locking piece 22 elastically slidable back and forth on the seat 21, a pushed block 23 on the seat 21 for elastically driving the locking piece 22, a control shaft 24 laterally threading through the lateral pieces 122, and a pushing block 25 engaged by the control shaft 24 to move laterally. The locking piece 22 has a back face 221. A slant pushing surface 251 of the pushing block 25 and a slant pushed surface 231 of the pushed block 23 interface with each other.

As shown in FIGS. 2 and 3, to fix the seat at a desired tilt angle, the locking piece 22 is engaged by the pushing and pushed blocks 25 and 23 to embed into a notch 1141 of the locking block. To release the seat from the desired angle, the locking piece 22 is retracted from the notch 1141.

The above described assembly can be easily installed to a seat. With the assembly, the seat can be tilted conveniently to fit a user's requirement so as to achieve better comfort.

SUMMARY OF THE INVENTION

A novel assembly for tilting a seat is provided so that its operation can be further simplified and enhanced. The assembly contains a base and a tilt adjustment member. The base has a frame with a seat attachment piece for attaching the frame to a seat cushion of the seat. A locking element is configured in the frame and has a number of notches. In front of the locking element, the frame has a fastening section so that the tilt adjustment member can be accommodated and joined to the frame. Each of the lateral sides of the frame has a through hole for a control rod to thread through. The tilt adjustment member contains a swing block, a seat, a locking piece, and a twisting element. By configuring the locking element and the tilt adjustment member on the base, and by using the control rod to engage the locking piece of the tilt adjustment member to interact the notches of the locking element, the seat can be tilted with simple operation and limited effort, thereby enhancing the functionality of the seat.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
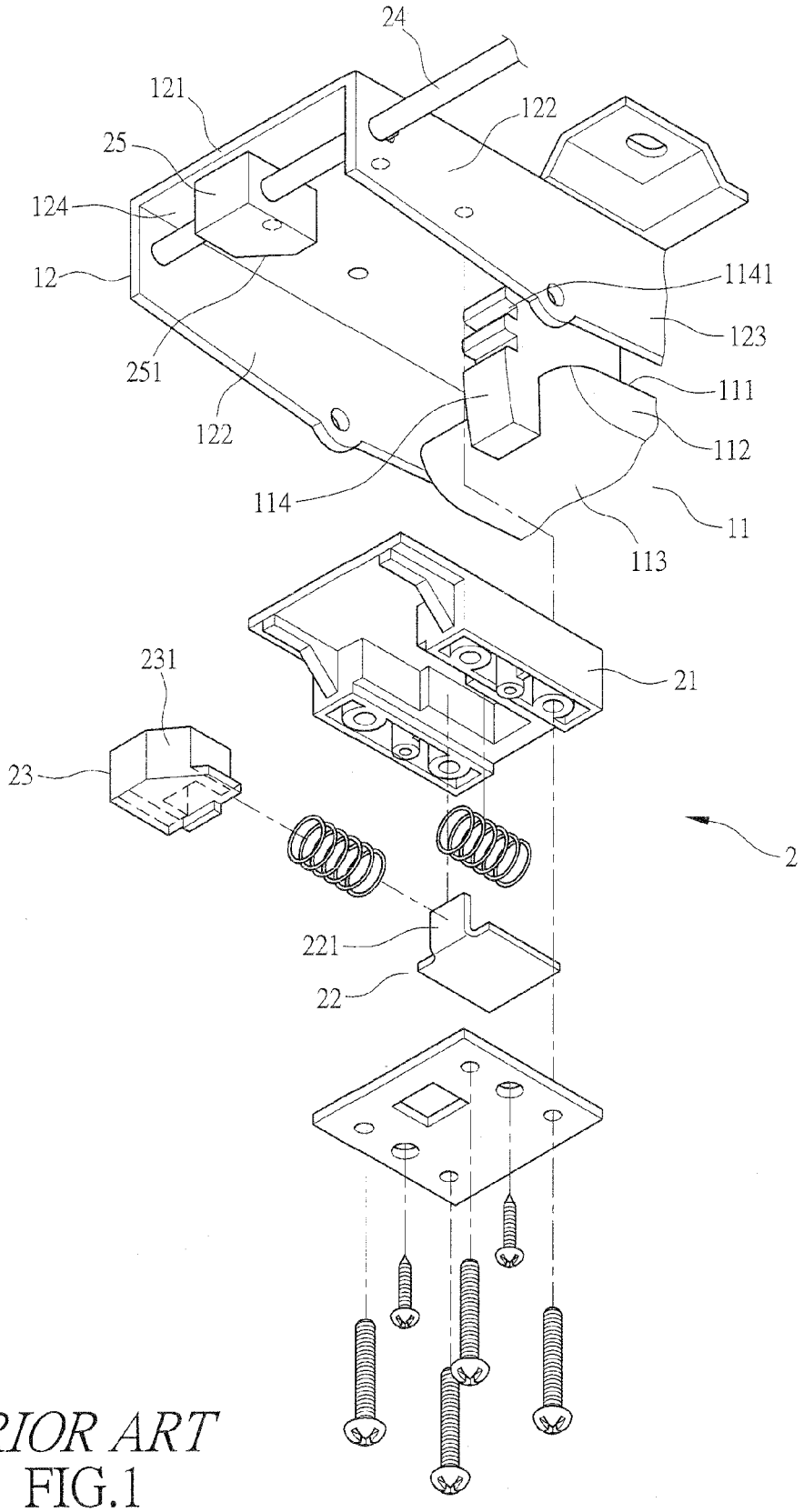
PRIOR ART FIG.1
FIG. 1 is a perspective break-down diagram showing the various components of the teaching of Taiwan Patent No. I245616.
Figure 2:
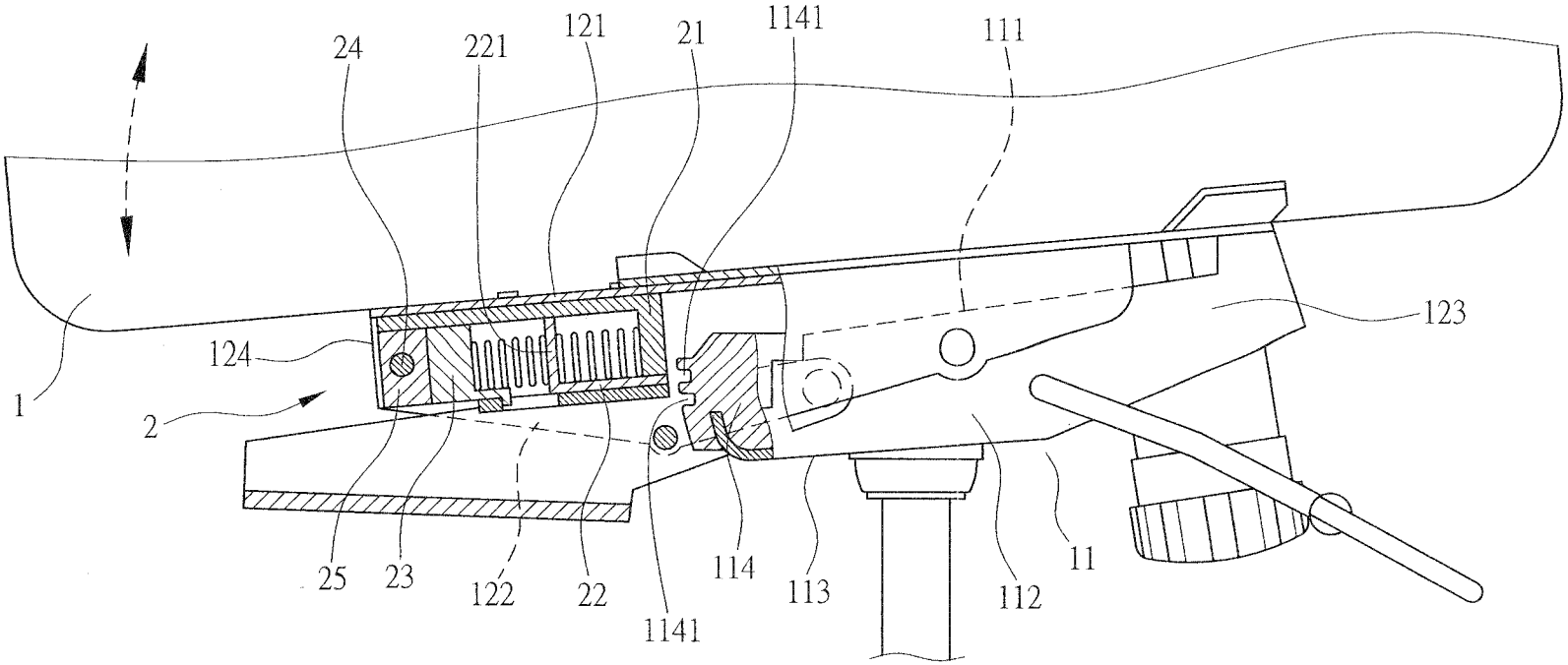
PRIOR ART FIG.2
FIGS. 2 and 3 are schematic sectional diagrams showing the operation of the teaching of Taiwan Patent No. I245616.
Figure 3:
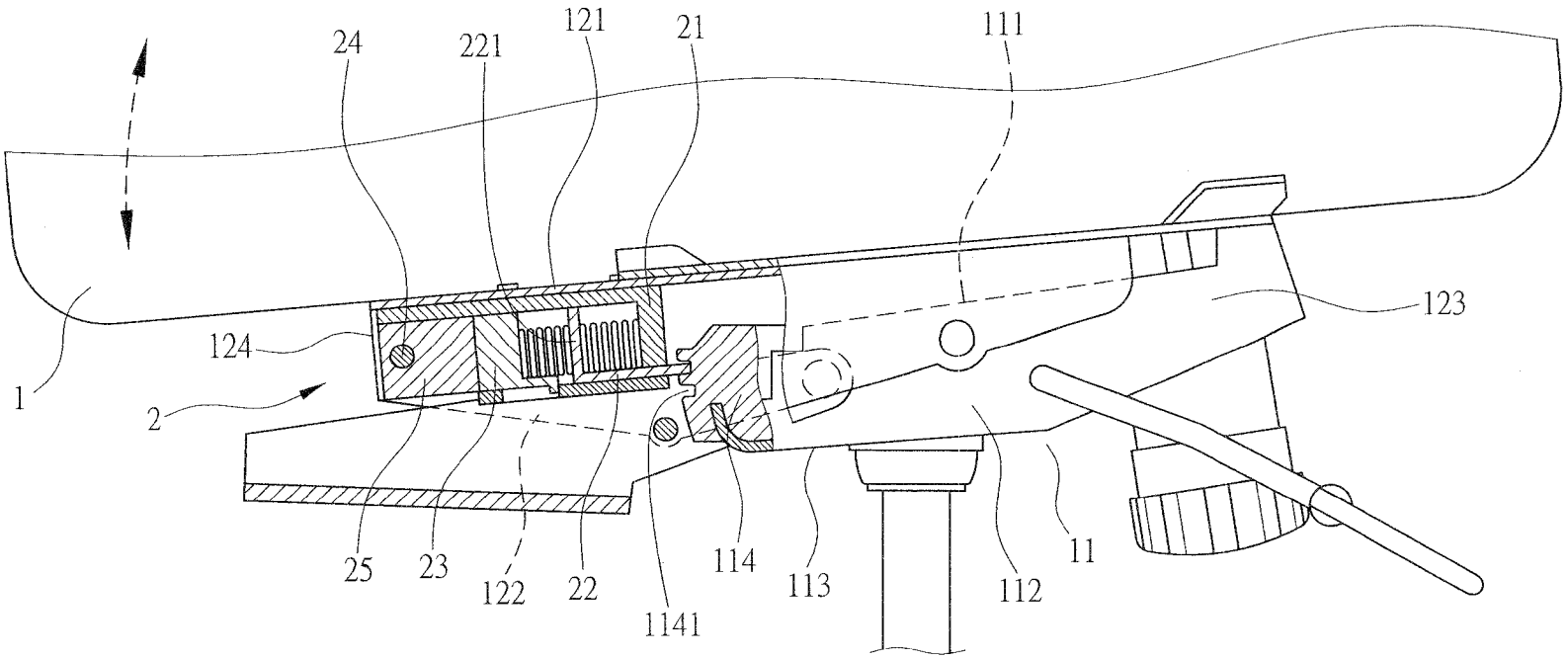
PRIOR ART FIG.3
Figure 4:
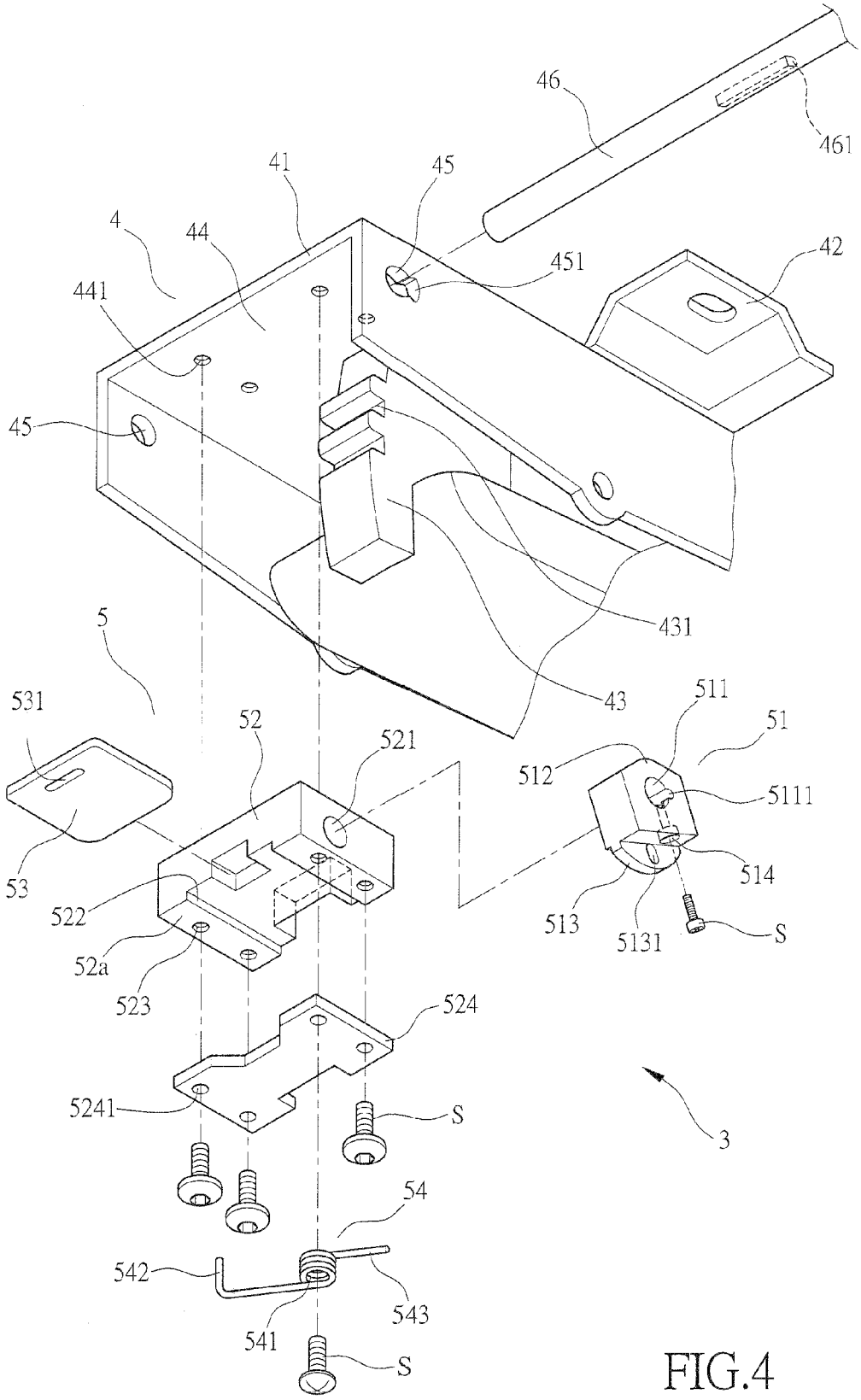
FIG. 4 is a perspective break-down diagram showing the various components of an assembly for tilting a seat according to an embodiment of the present invention.
Figure 5:
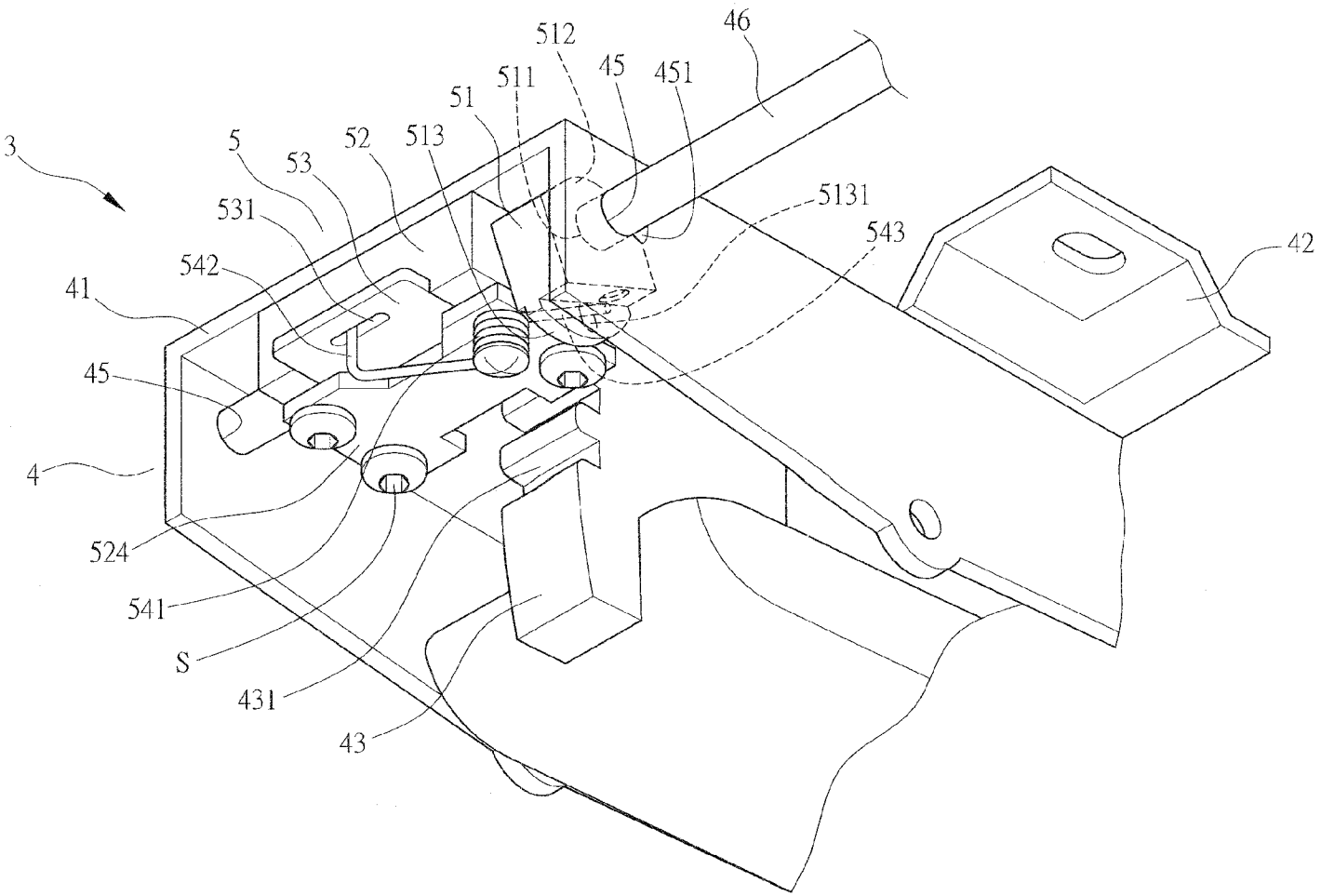
FIG. 5 is a perspective diagram showing the assembly for tilting a seat of FIG. 4 after its assembly.

As shown in FIGS. 4 and 5, an assembly for tilting a seat 3 contains a base 4 and a tilt adjustment member 5.

The base 4 has a frame 41 with a C-shaped cross-section. At least a seat attachment piece 42 is extended from a top side of the frame 41 for attaching the base 4 to a seat cushion 6 of the seat 3. A locking element 43 is configured in the frame 41 and has a number of notches 431 on a front side. In front of the locking element 43, the frame 41 has a fastening section 44 so that the tilt adjustment member 5 can be accommodated and joined to the frame 41 by bolting through a number of bolt holes 441 in the fastening section 44. Each of the lateral sides of the frame 41 has a through hole 45 for a control rod 46 to thread through and one of the through holes 45 has a fan notch 451. Correspondingly, the control rod 46 has an axially limiting rib 461 on the circumference. The notch 451 provides limitation to the limiting rib 461 of the control rod 46. The limiting rib 461 can only move through the notch 451.

The tilt adjustment member 5 contains a swing block 51, a seat 52, a locking piece 53, and a twisting element 54. The swing block 51 has a through channel 511 with a groove 5111 axially along the wall of the through channel 511. The swing block 51 has a bulge section 512 on a top side and a semicircular extension 513 extended from a bottom side. The extension 513 has an elongated hole 5131. The bottom side of the swing block 51 has a bolt hole 514 connecting the through channel 511. The through channel 511 is for the control rod 46 to thread through, and the groove 5111 is for limiting the limiting rib 461. A bolt S is driven through the bolt hole 514 and fixes the swing block 51 reliably to the control rod 46. The seat 52 has a through channel 521 running from a lateral side to the other. An indentation 522 is configured on a bottom side of the seat 52, thereby forming two walls 52*a* along the lateral sides of the indentation 522. Each of the walls 52*a* has a number of bolt holes 523. A cover 524 having bolt holes 5241 can be affixed to the bottom side of the seat 52 by running bolts S through the bolt holes 5241 and 523. The bolts S then run into the bolt holes 441 and lock the seat 52 to the fastening section 44. A locking piece 53 is positioned in the indentation 522. Adjacent to and along a front edge of the locking piece 53, a notch 531 is configured. The twisting element 54 has a pivot section 541 and, extended from the pivot section 541, a twist section 542 and a plug section 543. The twisting element 54 is fixed to the seat 52 by running a bolt S through the pivot section 541. The twist section 542 is embedded in the notch 531 of the locking piece 53. The plug section 54 is embedded in the elongated hole 5131 of the extension 513.

Figure 6:
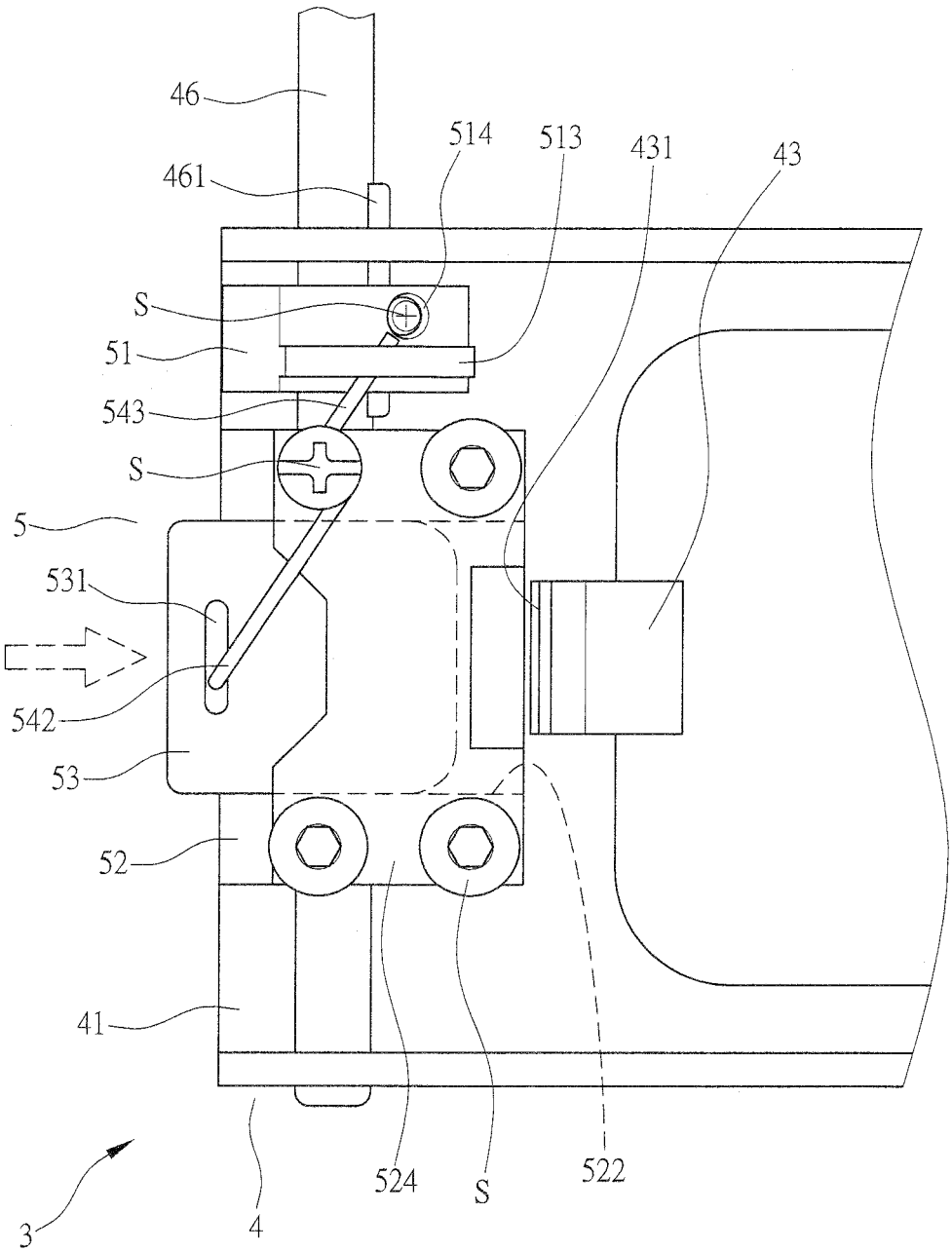
FIGS. 6 and 7 are schematic top-view and sectional diagrams showing an operation of the assembly for tilting a seat of FIG. 4.
Figure 7:
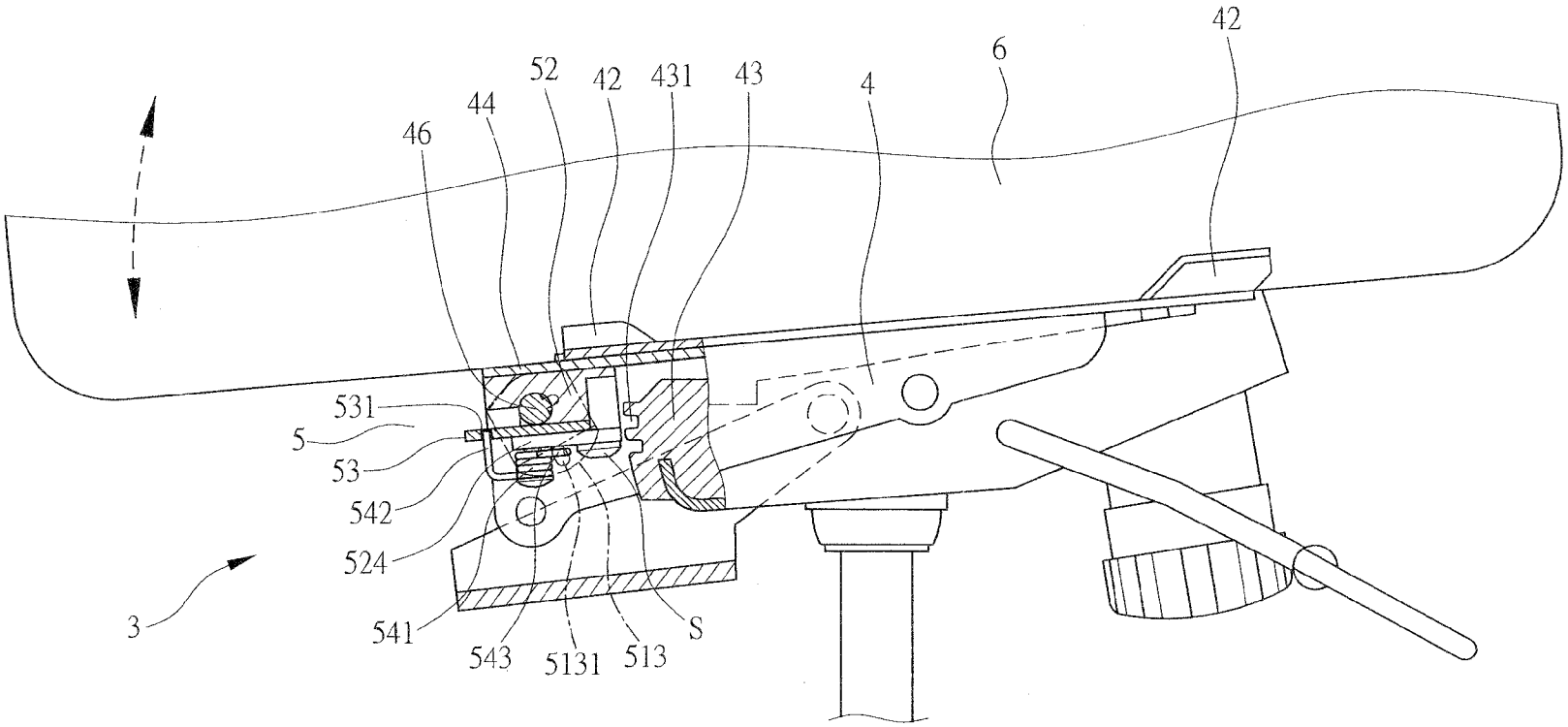

As shown in FIGS. 5 to 9, the assembly for tilting a seat 3 is assembled as follows. The locking piece 53 is positioned in the indentation 522 of the seat 52. The cover 524 is then affixed to the seat 52 by running bolts S through the bolt holes 5241 and 523. The bolts S then run into the bolt holes 441 and lock the seat 52 to the fastening section 44. The twisting element 54 is then pin-joined to the seat 52. The control rod 46 is threaded a through hole 45 of the base 4, the swing block 51, the seat 52, and the other through hole 45 of the base 4. As such, the swing block 51 is positioned to a side of the seat 52, and the bulge section 512 of the swing block 51 is against the fastening section 44 of the base 4. Finally, the base 4, together with the tilt adjustment member 5, is locked to a seat cushion 6 of a seat 3, as shown in FIGS. 5 and 7.

As shown in FIGS. 5 to 7, to adjust the tile angle of the seat 3 for better comfort, a user twist the control rob 46 to turn the swing block 51. As the swing block 51's bulge section 512 is against the fastening section 44 of the base 4, the swing block 51 is swung in a curved trajectory. More specifically, the bulge section 512 behaves like a cam performing a stroke on the fastening section 44 of the base 4. The extension 513 of the swing block 51 is also swung in the curved trajectory synchronously. The extension 513 as such engages the connected twisting element 54. The twist section 542 of the twisting element 54 in turn engages the locking piece 53 to move for a specific distance in the indentation 522 of the seat 52. As shown in FIG. 7, when the locking piece 53 is moved out of a notch 431 of the locking element 43, the base 4, without the obstruction of the locking piece 53, can be tilted for different angles. Since the base 4 is attached to the seat cushion 6, the seat cushion 6 is synchronously tilted.

Figure 8:
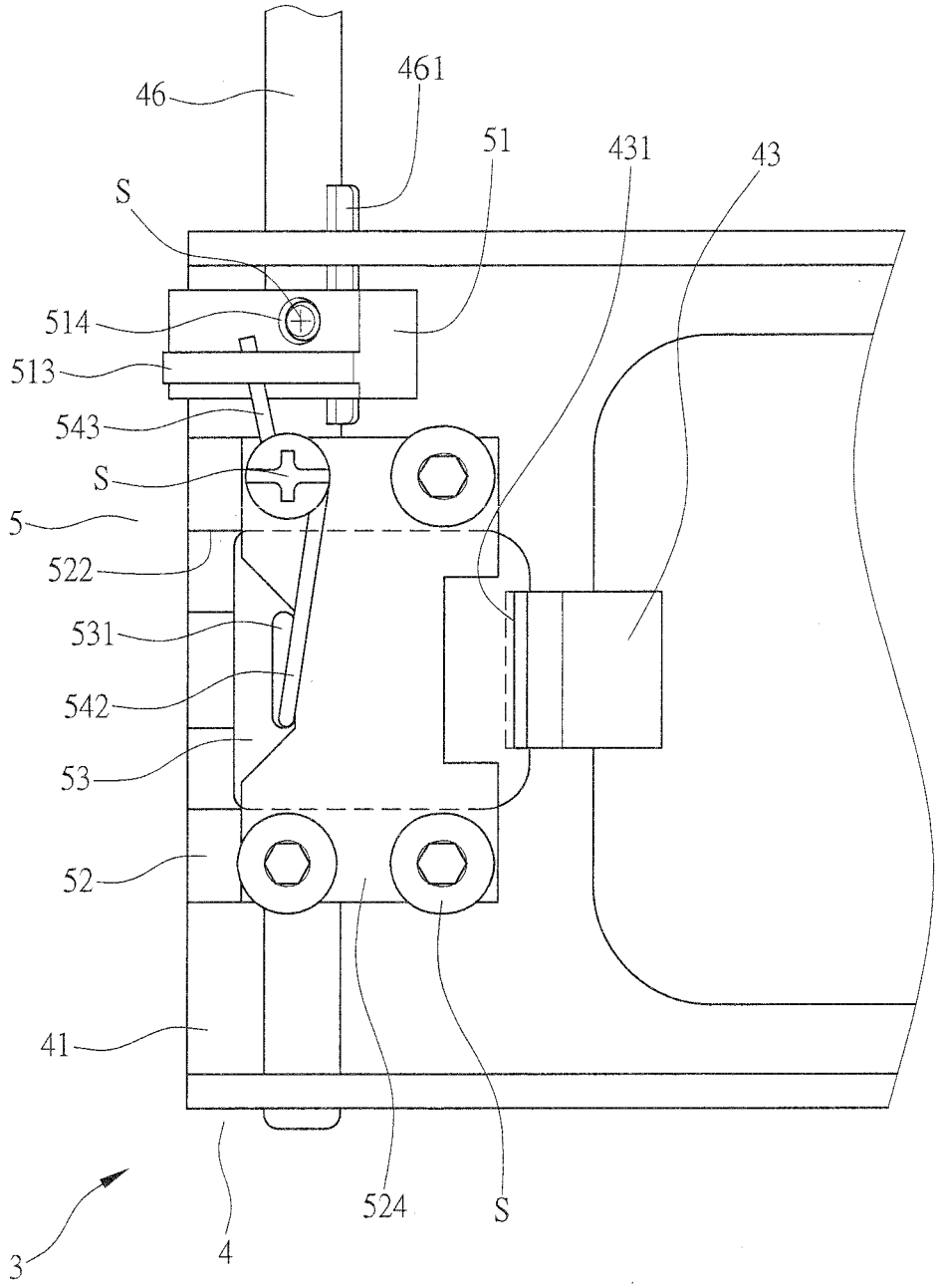
FIGS. 8 and 9 are schematic top-view and sectional diagrams showing another operation of the assembly for tilting a seat of FIG. 4.
Figure 9:
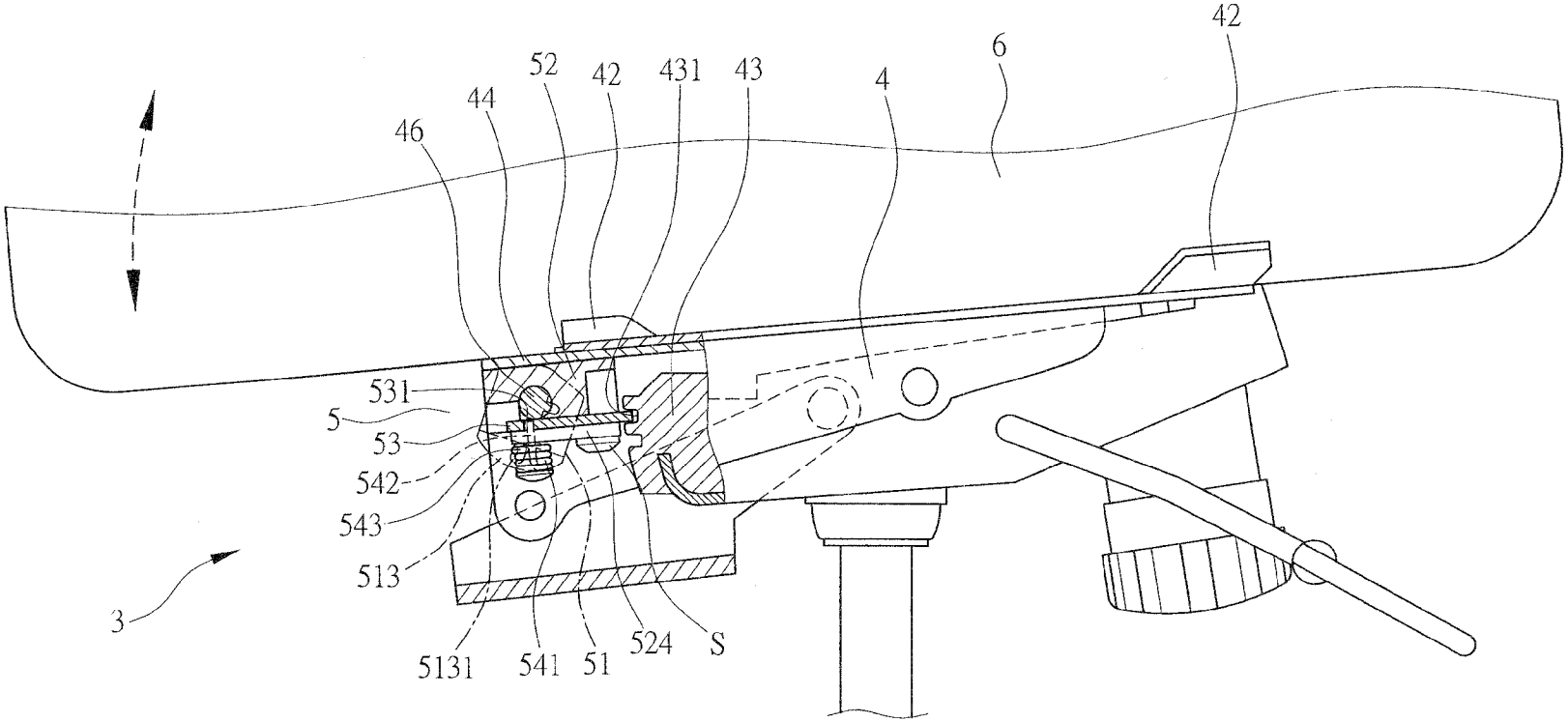

As shown in FIGS. 5, 8, and 9, after the seat 3 is tilted to a desired angle, the user can twist the control rod 46 again so as to engage the twisting element 54 to move the locking piece 53 in the indentation 522 of the seat 52. The locking piece 53 is then plugged into a notch 431 of the locking element 43. As such, the base 4 is limited at the desired angle by the confinement from the locking piece 53.

In summary, by configuring the locking element 43 and the tilt adjustment member 5 on the base 4, and by using the control rod 46 to engage the locking piece 53 of the tilt adjustment member 5 to interact the notches 431 of the locking element 43, the seat 3 can be tilted with simple operation and limited effort, thereby enhancing the functionality of the seat 3.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An assembly for tilting a seat, comprising a base and a tilt adjustment member wherein:

the base has a control rod having an axially limiting rib on the circumference, a frame with a seat attachment piece extended from a top side of the frame for attaching the base to the seat, a locking element configured in the frame having a plurality of notches on a front side;

the frame has a fastening section in front of the locking element for joining the tilt adjustment member and a through hole on each lateral side of the frame for the control rod to thread through;

the tilt adjustment member contains a swing block, a seat, a cover, a locking piece, a plurality of bolts, and a twisting element;

the swing block has a through channel for the control rod to thread through, a bulge section on a top side, and an extension extended from a bottom side having an elongated hole;

the cover has a plurality of bolt holes;

the seat has a through channel running from a lateral side to the other, an indentation configured on a bottom side of the seat, a plurality of bolt holes;

the bolts bolt the cover to the seat through the bolt holes of the seat and the cover and then into the fastening section so as to lock the tilt adjustment member to the fastening section;

the locking piece has a notch adjacent to and along a front edge of the locking piece;

the twisting element has a pivot section for joining to the seat by a bolt and, extended from the pivot section, a twist section embedded in the notch of the locking piece and a plug section embedded in the elongated hole of the extension;

a bottom side of the swing block has a bolt hole connecting the through channel;

a bolt is driven through the bolt hole of the swing block and fixes the swing block to the control rod; and the through channel of the swing block has a groove axially along the wall of the through channel for limiting the limiting rib of the control rod.

2. The assembly for tilting a seat according to claim 1, wherein the frame has a C-shaped cross-section.

3. The assembly for tilting a seat according to claim 1, wherein the fastening section is configured with a plurality of bolt holes for bolting the tilt adjustment member to the fastening section.

4. The assembly for tilting a seat according to claim 1, wherein one of the through holes has a fan notch providing limitation to the limiting rib of the control rod.

5. The assembly for tilting a seat according to claim 1, wherein the bulge section of the swing block is against the fastening section of the frame.

* * * * *